US011465797B2

(12) United States Patent
Swarts et al.

(10) Patent No.: US 11,465,797 B2
(45) Date of Patent: Oct. 11, 2022

(54) COLLAPSIBLE TRAVEL BOTTLE

(71) Applicant: Stojo Products Inc., Brooklyn, NY (US)

(72) Inventors: Jurrien Swarts, Brooklyn, NY (US); Richard Smiedt, Santa Monica, CA (US)

(73) Assignee: Stojo Products Inc., Brooklyn, NY (US)

( * ) Notice: Subject to any disclaimer, the term of this patent is extended or adjusted under 35 U.S.C. 154(b) by 182 days.

(21) Appl. No.: 16/745,742

(22) Filed: Jan. 17, 2020

(65) Prior Publication Data

US 2020/0231324 A1 Jul. 23, 2020

Related U.S. Application Data

(60) Provisional application No. 62/793,580, filed on Jan. 17, 2019.

(51) Int. Cl.

| | |
|---|---|
| ***B65D 1/02*** | (2006.01) |
| ***A45F 3/20*** | (2006.01) |
| *B65D 41/04* | (2006.01) |

(52) U.S. Cl.

CPC ..... *B65D 1/0292* (2013.01); *A45F 3/20* (2013.01); *B65D 1/0207* (2013.01); *B65D 1/0276* (2013.01); *A45F 2003/205* (2013.01); *B65D 41/0414* (2013.01); *B65D 2501/0036* (2013.01); *B65D 2501/0054* (2013.01)

(58) Field of Classification Search

CPC ..... B65D 1/0292; B65D 1/0207; B65D 2501/0036; B65D 2501/0054; B65D 1/0276; B65D 41/40; A45F 3/20; A45F 2003/205

See application file for complete search history.

(56) References Cited

U.S. PATENT DOCUMENTS

| | | | | |
|---|---|---|---|---|
| 5,206,037 | A * | 4/1993 | Robbins, III | B29C 53/08 264/295 |
| 5,384,138 | A * | 1/1995 | Robbins, III | B29C 53/08 426/111 |
| 5,642,826 | A * | 7/1997 | Melrose | B65D 1/0292 215/382 |
| 5,860,556 | A * | 1/1999 | Robbins, III | B65D 1/0292 220/666 |
| 8,887,942 | B2 * | 11/2014 | Miksovsky | B65D 1/40 220/521 |
| 2009/0057321 | A1 * | 3/2009 | Hong | B65D 21/0231 220/666 |

(Continued)

*Primary Examiner* — James N Smalley
*Assistant Examiner* — Jennifer Castriotta
(74) *Attorney, Agent, or Firm* — Warshaw Burstein, LLP

(57) ABSTRACT

A collapsible travel bottle comprising a flexible main body comprising an inner space for receiving a liquid therein, the main body including an upper portion, a middle portion, and a lower portion, an opening in the upper portion in communication with the inner space to allow receiving and discharging of the liquid within the flexible main body, a rigid collar coupled to the upper portion proximate the opening, a rigid cap coupled to the rigid collar to restrict receiving and discharging of the liquid within the flexible main body through the opening, the middle portion configured to enable both the top portion and the middle portion to collapse fully into the bottom portion.

18 Claims, 6 Drawing Sheets

(56) References Cited

U.S. PATENT DOCUMENTS

| | | | | |
|---|---|---|---|---|
| 2013/0020276 | A1* | 1/2013 | Madaus | B65D 1/0292 215/379 |
| 2013/0075393 | A1* | 3/2013 | Haynie | B65D 11/04 220/6 |
| 2015/0239621 | A1* | 8/2015 | Averill | B65D 41/086 215/329 |
| 2015/0251795 | A1* | 9/2015 | Tsui | A47L 19/04 215/306 |
| 2015/0297032 | A1* | 10/2015 | Abrams | A47J 41/0022 220/592.17 |
| 2017/0008670 | A1* | 1/2017 | Wu | A47G 19/2205 |

* cited by examiner

COLLAPSIBLE TRAVEL BOTTLE

RELATED APPLICATIONS

This application claims the benefit of U.S. Provisional Patent Application No. 62/793,580, filed Jan. 17, 2019, and titled "COLLAPSIBLE TRAVEL BOTTLE," which is hereby incorporated by reference its entirety for all purposes.

FIELD

This application relates to a collapsible travel bottle. Specifically, this application relates to a collapsible travel bottle with a flexible main body that includes an upper portion, a middle portion, and a lower portion. The flexible main body transitions between an expanded state in which the upper and middle portions are external to the lower portion and a collapsed state in which the upper and middle portions are fully enveloped within the lower portion. The lower portion may be bowl shaped and may have reinforced sides that maintains the bowl shape of the lower portion.

BACKGROUND

It is a primary objective of the present disclosure to provide a collapsible travel bottle. Consumers who desire to have a water bottle available for use "on the go" typically have two options. The first option is a disposable plastic water bottle, which is typically discarded following consumption of the liquid and, as such, creates waste. The second option is a reusable water bottle which, while reducing the waste, necessitates that the consumer carry the water bottle following the consumption of the liquid. Consumers typically select a reusable water bottle based on their concern of the impact that disposable cup waste have, on the environment, of the greater perceived material integrity of a reusable water bottle as compared to a disposable plastic bottle, and of the costs related to continually purchasing water bottles for single use. Consumers such as urban residents, city commuters, and university students have been less likely to utilize a reusable water bottle because of the need to store and transport the reusable tumbler on their person or in a briefcase or small bag they may be carrying following consumption. What is needed is a collapsible water bottle that provides for its easy transportation on a person or in a briefcase or small bag.

SUMMARY

In some embodiments, a collapsible travel bottle is provided, the collapsible travel bottle including a flexible main body comprising an inner space for receiving a liquid therein, the main body including an upper portion, a middle portion, and a lower portion. The collapsible travel bottle further including an opening in the upper portion in communication with the inner space to allow receiving and discharging of the liquid within the flexible main body, a rigid collar that couples to the upper portion proximate the opening, a rigid cap removably coupled to the rigid collar to restrict receiving and discharging of the liquid within the flexible main body through the opening, and the middle portion configured to enable both the top portion and the middle portion to collapse fully into the bottom portion.

In some embodiments, a method of manufacturing a collapsible travel bottle is provided, the method including the steps of providing a flexible main body comprising an inner space for receiving a liquid therein, the main body including an upper portion, a middle portion, and a lower portion, providing an opening in the upper portion in communication with the inner space to allow receiving and discharging of the liquid within the flexible main body, providing a rigid collar that couples to the upper portion proximate the opening, providing a rigid cap that couples to the rigid collar to restrict receiving and discharging of the liquid within the flexible main body through the opening, and providing that the middle portion is configured to enable both the top portion and the middle portion to collapse fully into the bottom portion.

Still, other aspects, features, and advantages of this disclosure may be readily apparent from the following detailed description, as illustrates by the example embodiments. This disclosure may also be capable of other and different embodiments, and its several details may be modified in various respects. Accordingly, the drawings and descriptions are to be regarded as illustrative and not as restrictive.

BRIEF DESCRIPTION OF THE DRAWINGS

The drawings, described below, are for illustrative purposes only and are not necessarily drawn to scale. The drawings are not intended to limit the scope of the disclosure in any way. Wherever possible, the same or like reference numbers are used throughout the drawings to refer to the same or like parts.

DETAILED DESCRIPTION

As mentioned above, this application relates to a collapsible travel bottle. Specifically, to a collapsible water bottle including a flexible main body comprising an inner space for receiving a liquid therein, the main body including an upper portion, a middle portion, and a lower portion. The collapsible water bottle may further include an opening in the upper portion in communication with the inner space to allow receiving and discharging of the liquid within the flexible main body. The collapsible travel bottle further including a rigid collar that couples to the upper portion proximate the opening, a rigid cap that removably couples to the rigid collar to restrict receiving and discharging of the liquid within the flexible main body through the opening. The rigid cap is held in place during use of the collapsible travel bottle by a lower retaining ridge and an upper retaining ridge of a seating wall that extends from the upper portion. The middle portion configured to enable both the top portion and the middle portion to collapse fully into the bottom portion.

Figure 1:
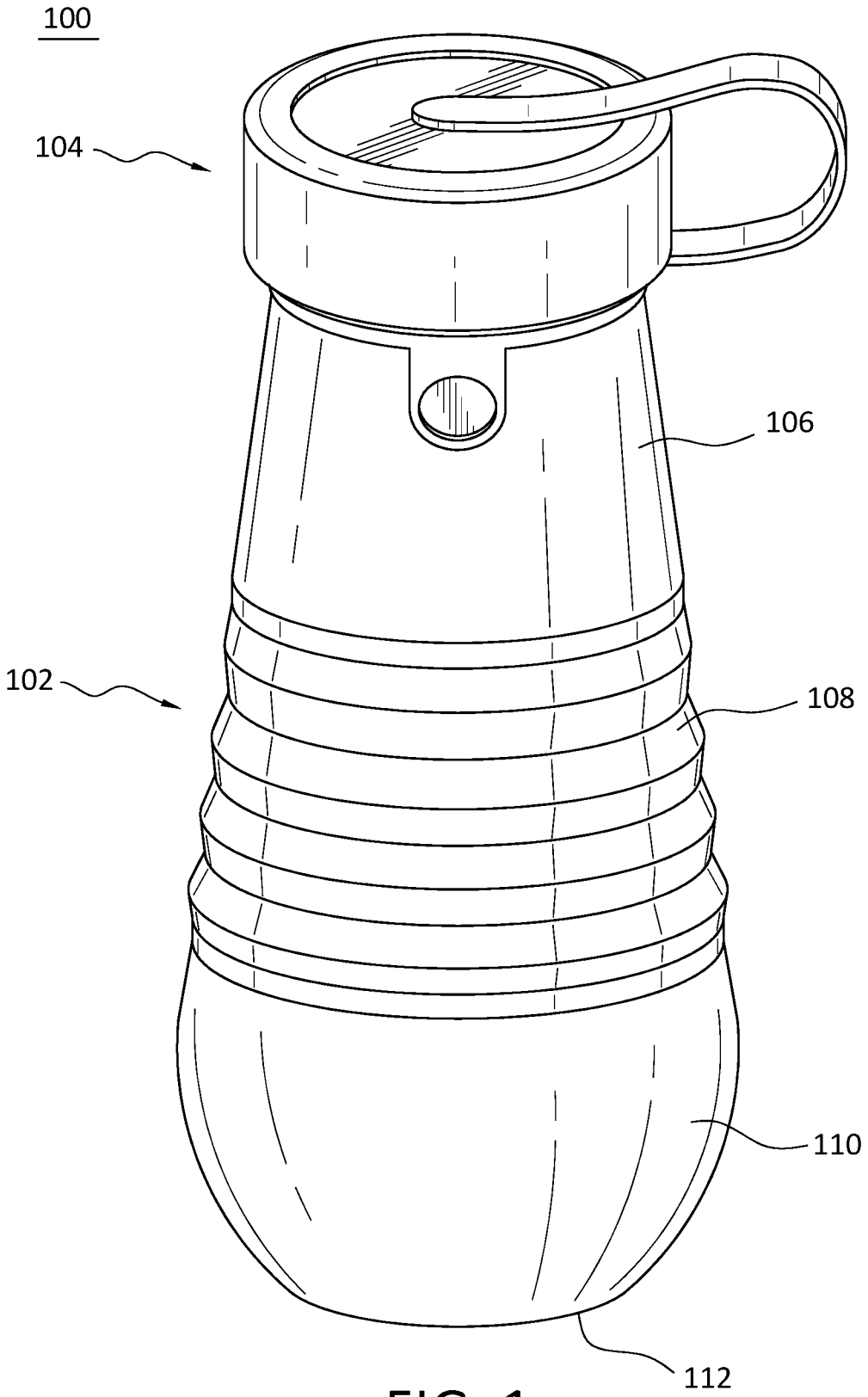
FIG. 1 is a perspective view of a collapsible travel bottle in an expanded state according to the embodiments disclosed herein.

FIG. 1 is a perspective view of a collapsible travel bottle 100 in an expanded state according to the embodiments disclosed herein. The collapsible travel bottle 100 may include a flexible main body 102 and a cap assembly 104.

The flexible main body 102 may include an upper portion 106, a middle portion 108, and a lower portion 110. The combination of the upper and middle portions 106, 108 may have a generally tapered conical shape while the bottom portion 110 may have a generally round bowl shape. The conical shape allows the upper and middle portions 106, 103 to collapse fully into the lower portion 110. The upper portion 106 may have a thickness that is sufficient to maintain its shape while retaining its flexibility.

The lower portion 110 may include a flat bottom portion 112 that allows the collapsible travel bottle 100 to sit upright on a flat surface.

The flexible main body 202 may be comprised of any material known to one of reasonable skill in the art that is both flexible and waterproof, including silicone rubber and synthetic elastomer.

The cap assembly 104 may be removably coupled to the upper portion 106 of the flexible main body 102, the rigid cap assembly 104 providing access to an inner space 114 (not shown) defined within the flexible main body 102.

Figure 2:
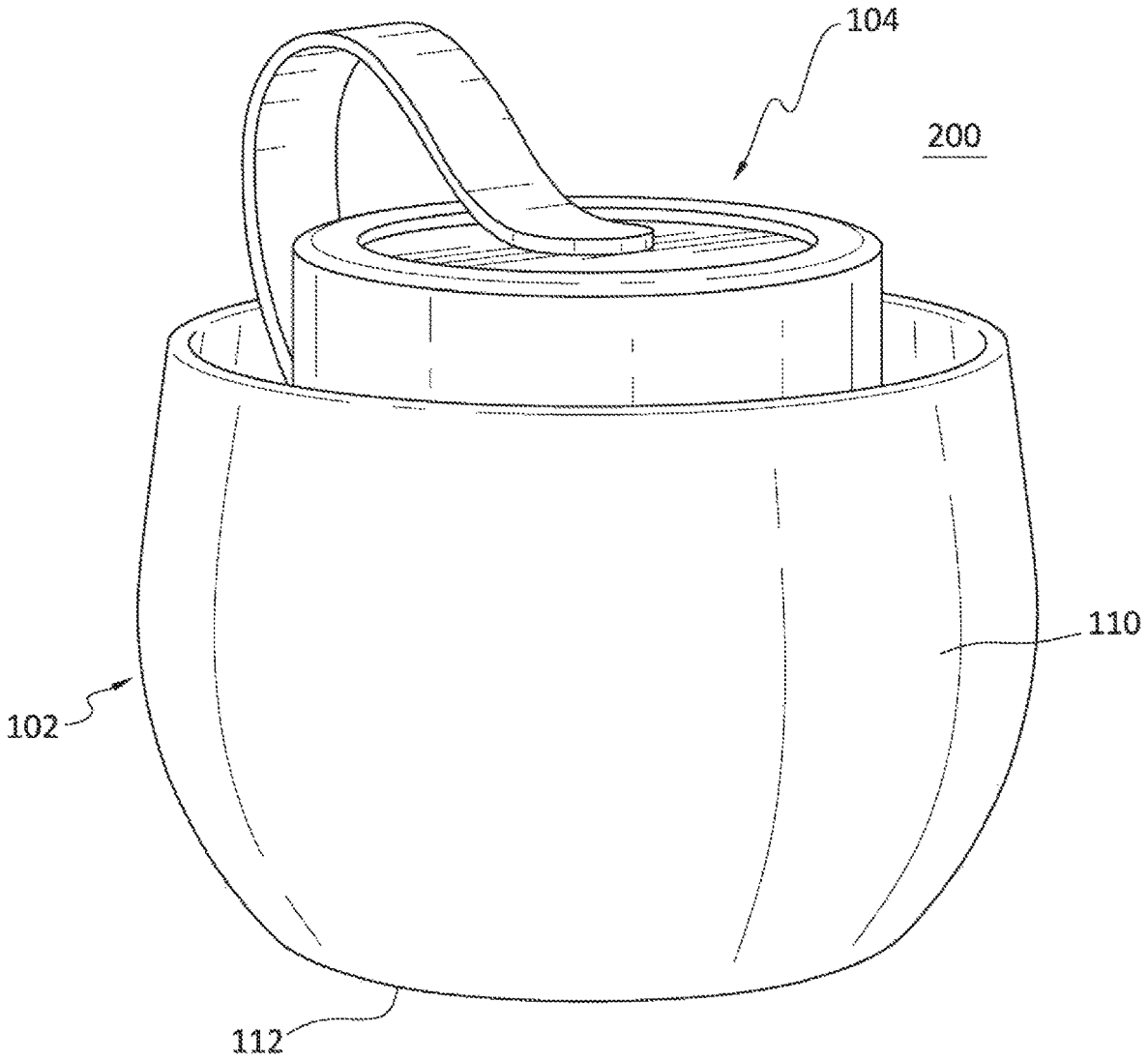
FIG. 2 is a perspective view of a collapsible travel bottle in a collapsed state according to the embodiments disclosed herein.

FIG. 2 is a perspective view of a collapsible travel bottle 200 in a collapsed state according to the embodiments disclosed herein. In the main body 102 is in the collapsed state, the upper and middle portions 106, 108 may each collapse downward towards the lower portion 110 until both the upper and middle portions 106, 108 (not shown) are fully enveloped within the lower portion 110. A portion of the cap assembly 104 may protrude from the lower portion 110 while in the main body 102 is in the collapsed state.

In the embodiment shown in FIG. 1, the longitudinal length of the lower portion 110 is greater than the longitudinal length of the upper portion 106 and greater than the longitudinal length of the riddle portion 108. These proportions allow the upper and middle portions 106, 108 to be fully enveloped within a portion of the inner space defined by the lower portion 110 when the rain body 102 is in the collapsed state, as shown in FIG. 2.

Figure 3:
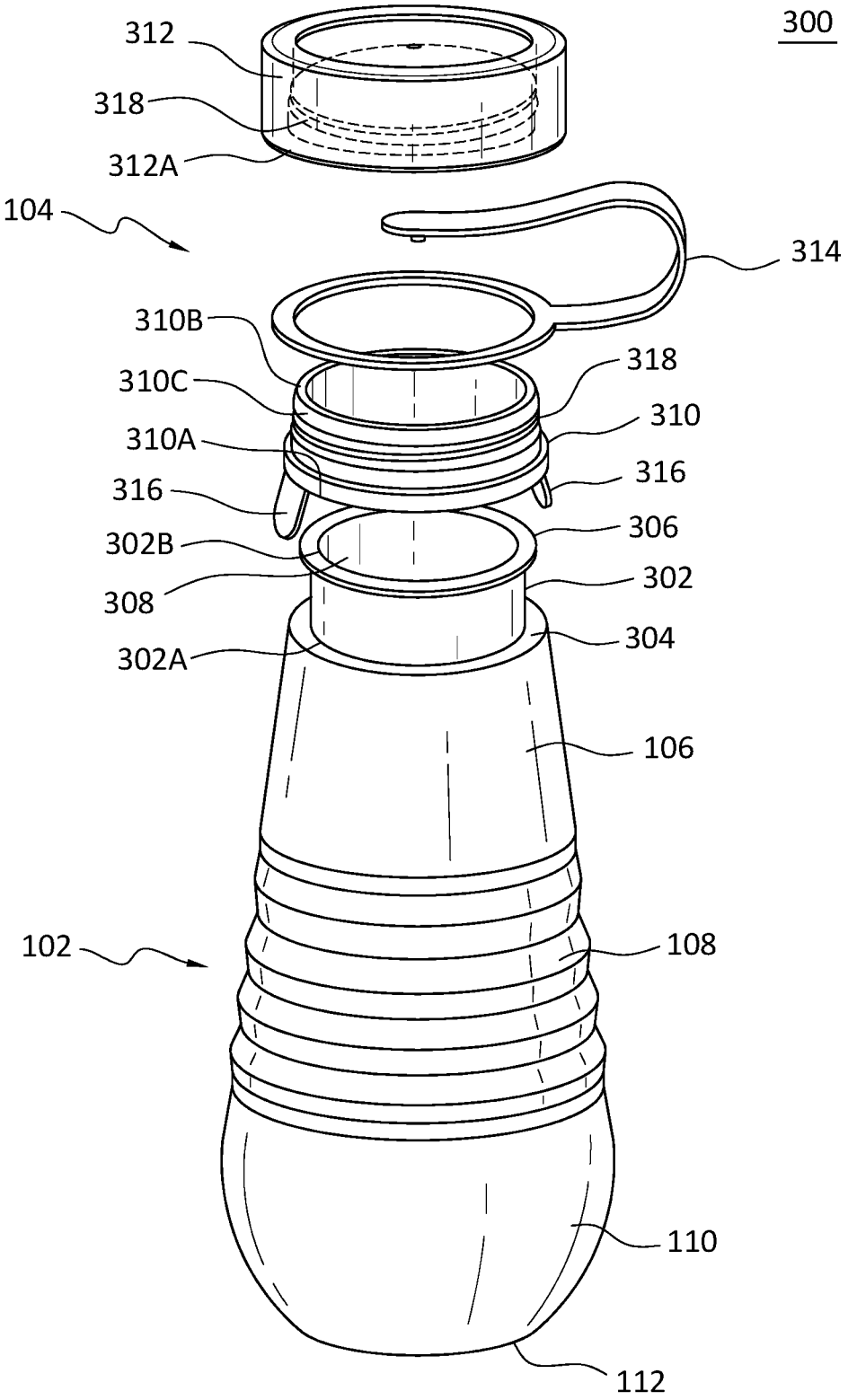
FIG. 3 is an exploded view of a collapsible travel bottle in an expanded state according to the embodiments disclosed herein.

FIG. 3 is an exploded view of a collapsible travel bottle 300 in an expanded state according to the embodiments disclosed herein. The flexible main body 102 may include a seating wall 302 that is cylindrical and that extends from the upper portion 106 of the flexible main body 102. A lower retaining ridge 304 is created at the intersection of the upper portion 106 and a first perimeter edge 302A of the cylindrical seating wall 302. An upper retaining ridge 306 extends from a second perimeter edge 302R of the cylindrical seating wall 302, the second perimeter edge 302B opposite the first perimeter edge 302A. The second peripheral edge 302B defining an opening 308 that provides access to the inner space 114 defined within the flexible main body 102.

The seating wall 302, the lower retaining ridge 304 and the upper retaining ridge 306 may each be comprised of any material known to one of reasonable skill in the art that is both flexible and waterproof, including silicone rubber and synthetic elastomer.

The cap assembly 104 may include a rigid collar 310, a rigid cap 312, and a retaining strap 314. The rigid collar 310 may be cylindrical with an inner circumference that is generally equal to an outer circumference of the seating wall 302. A lower circumferential edge 310A of the rigid collar 310 may have a depth generally equal to a depth of the lower retaining ridge 304. Similarly, an upper circumferential edge 310B of the rigid collar 310 may have a depth generally equal to a depth of the upper retaining ridge 306. When set in place on the flexible main body 102, the rigid collar 310 may press against the cylindrical seating wall 302 and may be secured in-between the lower retaining ridge 304 and the upper retaining ridge 306. The lower retaining ridge 304 and the upper retaining ridge 306 hold the rigid collar 310 in place against the seating wall 302 while the main body 102 transitions between the expanded state and the collapsed state. Moreover, the flexibility of the seating wall 302 allows for the removal of the rigid collar 310 over the upper retaining ridge 306 when necessary.

A pair of opposite facing tabs 316 may extend downward towards the lower portion 110 from the lower circumferential edge 310A of the rigid collar 310. The tabs 316 may be used to grab and pull the upper portion 106 to enable the transition of the flexible main body 102 between the expanded state to the collapsed state. The tabs 316 may also be used to hold the collapsible travel bottle 100 while using the collapsible travel bottle 100 in the expanded state.

In one embodiment, the tabs 316 may be approximately 0.6 inches wide.

The rigid cap 312 may be removably coupled to the rigid collar 310 using complementary threads 318 on an inner surface 312A of the rigid cap 312 and on the outer surface 310C of the rigid collar 310. Once the rigid cap 312 has been fully screwed onto the rigid collar 310, the upper retaining ridge 306 is compressed in-between the inner surface 312A of the rigid cap 312 and the upper circumferential edge 310B of the rigid collar 310. This compression of the upper retaining ridge 306 provides for a liquid proof seal that serves to retain liquids within the inner space 114 of the flexible main body 102.

The rigid cap 332 may be removably coupled to the rigid collar 310 using any other means known to one of ordinary skill in the art.

The rigid collar 310 and the rigid cap 312 may each be composed of any rigid and waterproof material known to one of reasonable skill in the art, including plastic and metal.

The retaining strap 314 is configured to secure the rigid cap 312 to the rigid collar 310 while the rigid cap 312 is not coupled to the rigid collar 310.

Figure 4:
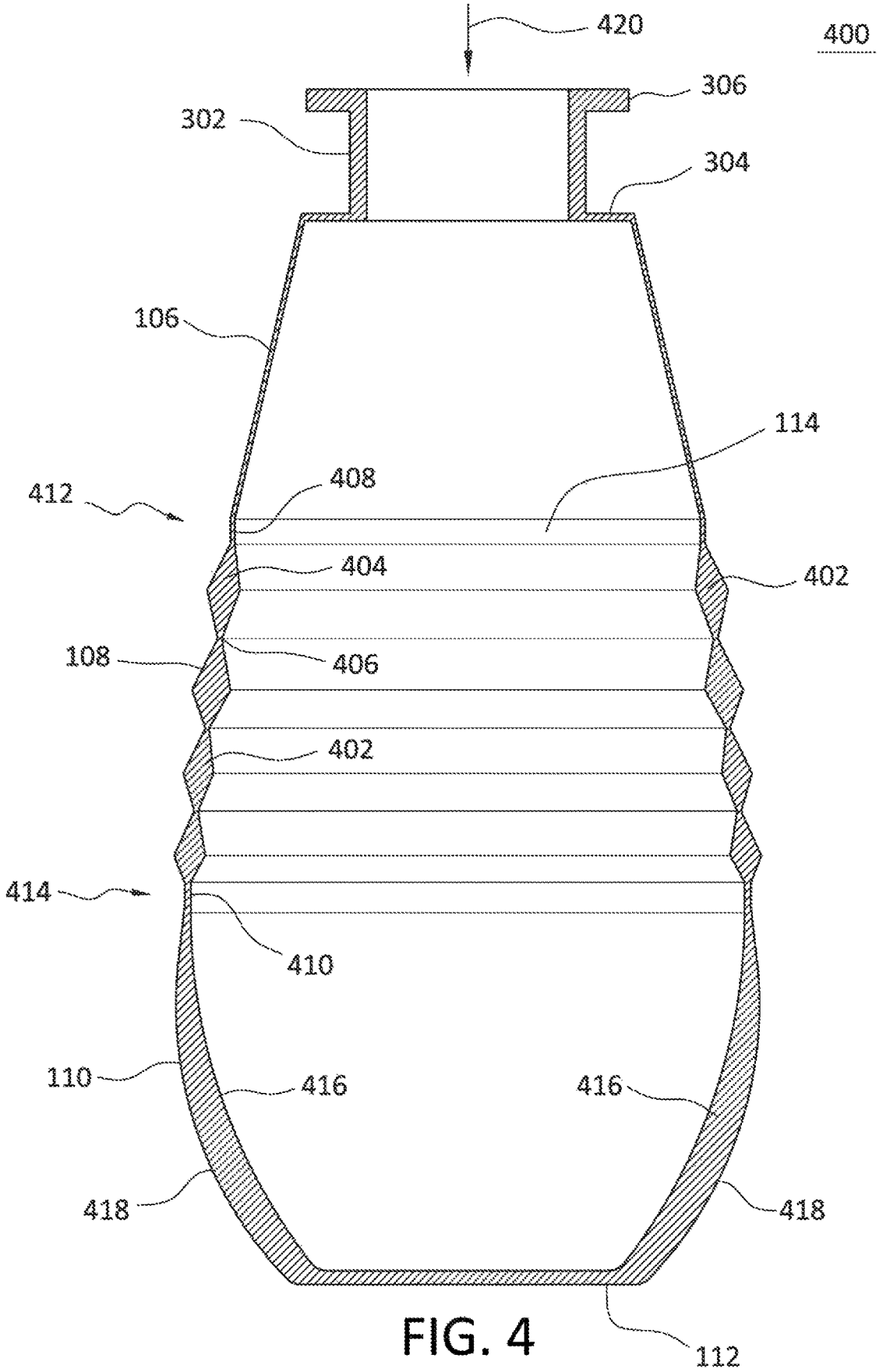
FIG. 4 is a cross sectional view of a flexible main body in an expanded state according to the embodiments disclosed herein.

FIG. 4 is a cross sectional view of a flexible main body 400 in an expanded state according to the embodiments disclosed herein. The middle portion 108 may include a plurality of minor stages 402 positioned in-between an upper articulating wall 408 and a lower articulating wall 410.

Each of the plurality of minor stages 402 may have a generally diamond shape with a thick inflexible center 404 and thin flexible longitudinal edges 406. Each of the plurality of minor stages 402 is connected to one other at their respective flexible longitudinal edges 406. The thick inflexible center 404 provides for greater support while in the expanded state, while the thin flexible longitudinal edges 406 provide for greater flexibility while transitioning between the expanded state and the collapsed state.

The flexible longitudinal edges 406 allows each of the plurality of minor stages 402 to bend at its respective flexible longitudinal edge 406. Accordingly, the flexible longitudinal edges 406 allow each of the plurality of minor stages 402 to fold over a neighboring one of the plurality of minor stages 402 as the flexible main body 102 transitions between the expanded state and the collapsed state.

The upper articulating wall 408 may couple a first end 412 of the middle portion 108 to the upper portion 106. The upper articulating wall 408 is flexible in a manner as to bias the upper portion 106 into a portion of the inner space 114 defined by the middle portion 106 when a downward force 420, towards the lower portion 110, is applied at the upper portion 106.

The lower articulating wall 410 may couple a second end 414 of the middle portion 108 to the lower portion 110, the second end 414 of the middle portion 108 being opposite the first end 412 of the middle portion 108. The lower articulating wall 410 is flexible in a manner as to bias the middle portion 108 into a portion of the inner space 114 defined by the lower portion 108 when the downward force 420 towards the lower portion 110 is applied at the upper portion 106.

The upper articulating wall 408 and the lower articulating wall 410 are each sufficiently thin compared to the rest the main body 102 as to ensure that they are the first to collapse when the downward force 420 towards the lower portion 110 is applied at the upper portion 106.

The lower portion 110 may be generally round bowl shaped with a reinforcing element 416 embedded circumferentially within the walls 418 of the lower portion 110. The reinforcing element 415 may be rigid or semi-rigid as to maintain the round bowl shape of the lower portion 110 while the downward force 420 towards the lower portion 110 is applied at the upper portion 105. The reinforcement element 416 may be comprised of a thicker gauge of the same material comprising the flexible main body 102. The thicker portions of the flexible main body 102 having less flexibility of the remainder of the flexible main body 102.

Figure 5:
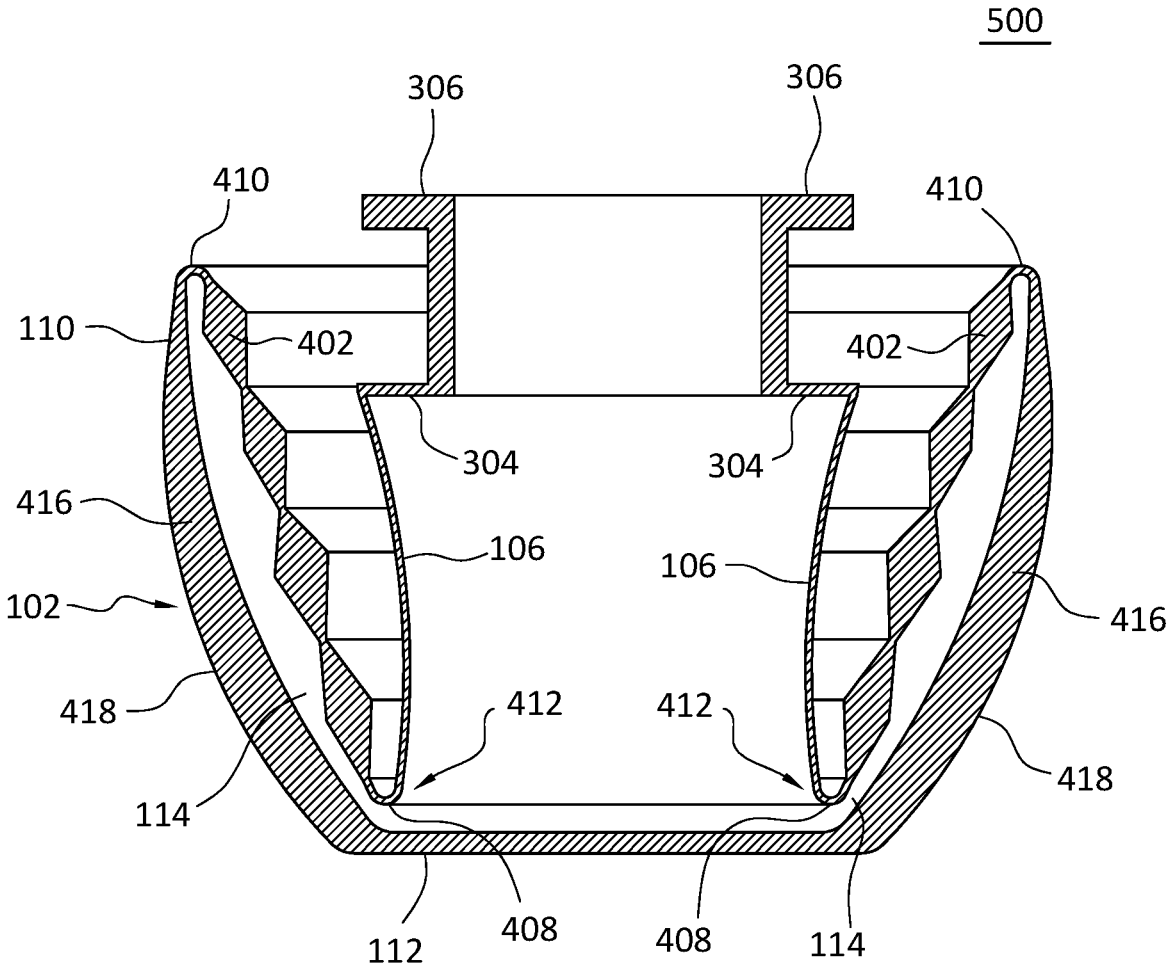
FIG. 5 is a cross sectional view of a flexible main body in a collapsed state according to the embodiments disclosed herein.

FIG. 5 is a cross sectional view of a flexible main body 500 in a collapsed state according to the embodiments disclosed herein. As shown, with the main body 102 in the collapsed state, the upper portion 106 is positioned in-between the plurality of minor stages 402 and within a portion of the inner space 114 defined within the lower portion 110. Similarly, in the collapsed state, the plurality of minor stages 402 is positioned within the portion of the inner space 114 defined within the lower portion 110. The first end 412 of the middle portion 108 is positioned towards the flat bottom portion 112 of the lower portion 110.

Figure 6:
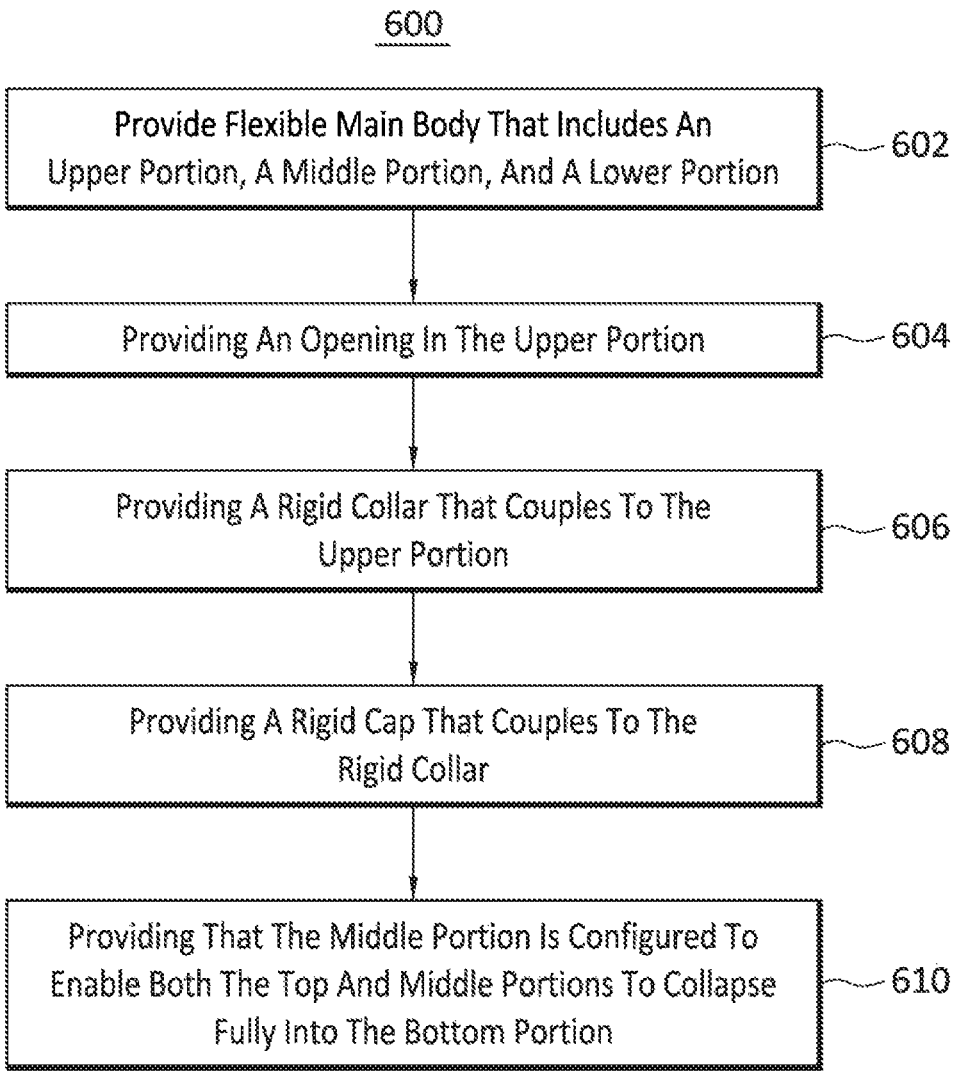
FIG. 6 is a flowchart illustrating an example method for manufacturing a collapsible travel bottle according to the embodiments disclosed herein.

FIG. 6 is a flowchart illustrating an example method 600 for manufacturing a collapsible travel bottle according to the embodiments disclosed herein. The method 600 begins in step 602 with providing a flexible main body comprising an inner space for receiving a liquid therein, the main body including an upper portion, a middle portion, and a lower portion. The method 600 continues, in step 604, with providing an opening in the upper portion in communication with the inner space to allow receiving and discharging of the liquid within the flexible main body. The method 600 continues, in step 606, with providing a rigid collar that couples to the upper portion proximate the opening. The method 600 continues, in step 608, with providing a rigid cap that couples to the rigid collar to restrict receiving and discharging of the liquid within the flexible main body through the opening. Finally, the method 600 ends, in step 610, with providing that the middle portion is configured to enable both the top portion and the middle portion to collapse fully into the bottom portion.

The foregoing description discloses only example embodiments of the invention. Modifications of the above-disclosed apparatus, systems, and methods that fall within the scope of the invention will be readily apparent to those of ordinary skill in the art. Accordingly, while the present invention has been disclosed in connection with example embodiments, it should be understood that other embodiments may fall within the scope of the invention, as defined by the following claims.

What is claimed is:

1. A collapsible travel bottle comprising:

a flexible main body comprising an inner space for receiving a liquid therein, the flexible main body including an upper portion, a middle portion, and a lower portion;

an opening in the upper portion in communication with the inner space to allow receiving and discharging of the liquid within the flexible main body;

a flat bottom portion in the lower portion to allow retaining of the liquid within the flexible main body;

a rigid collar that couples to the upper portion proximate the opening;

a rigid cap that couples to the rigid collar to restrict receiving and discharging of the liquid within the flexible main body through the opening;

an upper articulating wall connecting the middle portion to the upper portion;

a lower articulating wall connecting the middle portion to the lower portion;

the middle portion configured to enable both the upper portion and the middle portion to collapse fully into the lower portion;

the lower portion configured to have an outer diameter that increases to a maximum outer diameter as the lower portion extends from the lower articulation wall down towards the flat bottom portion of the lower portion and that then decreases as the lower portion continues to extend down to the flat bottom portion of the lower portion; and a reinforcing element circumferentially embedded within the lower portion as to extend from the lower articulation wall down to the flat bottom portion of the lower portion.

2. The collapsible travel bottle of claim 1, wherein the middle portion is comprised of a plurality of minor stages that are interconnected and are positioned in-between the upper articulating wall and the lower articulating wall.

3. The collapsible travel bottle of claim 2, wherein each of the plurality of minor stages is diamond shaped and are interconnected at their longitudinal ends.

4. The collapsible travel bottle of claim 2, wherein the upper articulating wall collapses to allow the upper portion to transition partially into a portion of the inner space defined by the middle portion, and wherein the lower articulating wall collapses to allow the middle portion to transition partially into a portion of the inner space defined by the lower portion.

5. The collapsible travel bottle of claim 4, wherein the plurality of minor stages fold onto one another to allow the upper portion and the middle portion to transition fully into the portion of the inner space defined by the lower portion.

6. The collapsible travel bottle of claim 1, wherein the upper portion, the middle portion, and the lower portion are composed of silicone rubber.

7. The collapsible travel bottle of claim 6, wherein the upper portion, the middle portion, and the lower portion are each composed of a synthetic elastomer.

8. The collapsible travel bottle of claim 1, further comprising a circumferential seating wall extending from the upper portion.

9. The collapsible travel bottle of claim 8, wherein the circumferential seating wall has a diameter and a height generally equal to a diameter and a height of the rigid collar.

10. The collapsible travel bottle of claim 8, further comprising an upper retaining ridge extending from a first perimeter edge of the circumferential seating wall, the upper retaining ridge sandwiched between the rigid collar and the rigid cap while the rigid cap is coupled to the rigid collar.

11. The collapsible travel bottle of claim 10, further comprising a lower retaining ridge extending from a second perimeter edge of the circumferential seating wall, the second perimeter edge opposite the first perimeter edge.

12. The collapsible travel bottle of claim 1, wherein the rigid cap is coupled to the rigid collar using a threaded connection between the rigid cap and the rigid collar.

13. The collapsible travel bottle of claim 1, wherein the lower portion includes a flat base.

14. The collapsible travel bottle of claim 1, wherein the reinforcing element is comprised of a thicker version of the same material as the rest of the flexible main body.

15. The collapsible travel bottle of claim 1, wherein the upper portion and the middle portion have a generally tapered conical shape.

16. The collapsible travel bottle of claim 1, further comprising a restraining strap that couples the rigid cap to the rigid collar.

17. The collapsible travel bottle of claim 1, further comprising a pair of opposite facing tabs extending downward from the rigid collar towards the lower portion.

18. A method of manufacturing a collapsible travel bottle including the steps of:

providing a flexible main body comprising an inner space for receiving a liquid therein, the flexible main body including an upper portion, a middle portion, and a lower portion;

providing an opening in the upper portion in communication with the inner space to allow receiving and discharging of the liquid within the flexible main body;

providing a flat bottom portion in the lower portion to allow retaining of the liquid within the flexible main body;

providing a rigid collar that couples to the upper portion proximate the opening;

providing a rigid cap that couples to the rigid collar to restrict receiving and discharging of the liquid within the flexible main body through the opening;

providing an upper articulating wall connecting the middle portion to the upper portion;

providing a lower articulating wall connecting the middle portion to the lower portion;

providing that the middle portion is configured to enable both the upper portion and the middle portion to collapse fully into the lower portion;

providing that the lower portion has an outer diameter that increases to a maximum outer diameter as the lower portion extends from the lower articulating wall down towards the flat bottom portion of the lower portion and that then decreases as the lower portion continues to extend down to the flat bottom portion of the lower portion; and providing a reinforcing element embedded circumferentially within the lower portion as to extend from the lower articulating wall down to the flat bottom portion of the lower portion.

* * * * *